US010477914B2

(12) United States Patent
Möhlmann et al.

(10) Patent No.: US 10,477,914 B2
(45) Date of Patent: Nov. 19, 2019

(54) SHOE HAVING A SOLE STRUCTURE AND AN AIR PUMP DEVICE FOR BLOWING AIR INTO A SHOE INTERIOR SPACE

(71) Applicant: ATMOS airwalk ag, Zürich, Glattbrugg (CH)

(72) Inventors: Wilhelm Möhlmann, Glattbrugg Zürich (CH); Jens Schmidt, Obersimten Rheinland-Pfalz (DE)

(73) Assignee: ATMOS AIRWALK AG, Zurich Glattbrugg (CH)

( * ) Notice: Subject to any disclaimer, the term of this patent is extended or adjusted under 35 U.S.C. 154(b) by 361 days.

(21) Appl. No.: 15/415,257

(22) Filed: Jan. 25, 2017

(65) Prior Publication Data

US 2018/0125151 A1 May 10, 2018

(30) Foreign Application Priority Data

Nov. 4, 2016 (EP) ..... 16197329

(51) Int. Cl.

| | |
|---|---|
| ***A43B 13/20*** | (2006.01) |
| ***A43B 7/08*** | (2006.01) |
| ***A43B 1/00*** | (2006.01) |
| ***A43B 13/12*** | (2006.01) |
| ***A43B 13/18*** | (2006.01) |

(52) U.S. Cl.

CPC ..... *A43B 7/081* (2013.01); *A43B 1/0018* (2013.01); *A43B 7/084* (2013.01); *A43B 13/12* (2013.01); *A43B 13/186* (2013.01); *A43B 13/188* (2013.01); *A43B 13/203* (2013.01); *A43B 13/206* (2013.01)

(58) Field of Classification Search

CPC ..... A43B 7/081; A43B 13/20; A43B 13/203; A43B 21/28

USPC ..... 36/29

See application file for complete search history.

(56) References Cited

U.S. PATENT DOCUMENTS 5,860,225 A 1/1999 O'Dwyer et al.
6,044,577 A * 4/2000 Clark ..... A43B 7/081 36/29

(Continued)

FOREIGN PATENT DOCUMENTS

EP 2218348 A1 8/2010
WO WO 2012/126489 A1 9/2012

OTHER PUBLICATIONS

European Search Report issued in European Patent Application No. 16197329, dated Mar. 23, 2017(German).

*Primary Examiner* — Timothy K Trieu
(74) *Attorney, Agent, or Firm* — Parker Highlander PLLC

(57) ABSTRACT

A shoe has an air pump device comprising a bellows formed in a cavity in a heel area of the sole structure. The cavity has an average height of at least 4 mm and extends horizontally over most of the surface of the heel area, so that a support strip of the compressible material of the at least one intermediate layer remains between the cavity and the outside edges of the sole structure on the sides and at the heel, wherein the support strip extends vertically over the full height of the cavity and the average width of the support strip is not more than 20% of the maximum width of the heel area measured transversely to the walking direction. The compressible material has an average hardness between 30 and 55 Shore-A at least in the area of the support strip.

31 Claims, 2 Drawing Sheets

(56) References Cited

U.S. PATENT DOCUMENTS

| | | | | |
|---|---|---|---|---|
| 6,247,248 | B1 * | 6/2001 | Clark | A43B 7/08 36/29 |
| 8,037,623 | B2 * | 10/2011 | Passke | A43B 7/081 36/153 |
| 2002/0050074 | A1 * | 5/2002 | Ricco | A43B 7/02 36/3 R |
| 2008/0184596 | A1 * | 8/2008 | Yu | A43B 13/141 36/88 |
| 2014/0075777 | A1 | 3/2014 | Bruce et al. | |

* cited by examiner

SHOE HAVING A SOLE STRUCTURE AND AN AIR PUMP DEVICE FOR BLOWING AIR INTO A SHOE INTERIOR SPACE

CROSS-REFERENCE TO RELATED APPLICATIONS

This application claims priority to European Patent Application No. 16 197 329.2, filed Nov. 4, 2016 the entire contents of which are incorporated herein by reference.

BACKGROUND INFORMATION

The invention relates to a shoe comprising a sole structure having a top side facing towards a shoe interior space, and an air pump device for blowing air into the shoe interior space, the air pump device comprising a bellows formed in a cavity in a heel area of the sole structure, an intake channel coupled to the bellows for transporting air to the bellows from an intake opening, and an air supply device coupled to the bellows for forwarding air from the bellows into the interior space of the shoe.

Such a shoe is known for example from the documents EP 2 218 348 A1 and WO 2012/126489 A1. In the known shoes of the kind described in the introduction, the sole structure may have a multilayer construction in the heel area, wherein an intermediate layer in which the cavity is located is made from a material (soft polyurethane foam for example) that is intended to be more elastic or more compressible than the material of the outsole. The outsole should be made from abrasion-resistant rubber. The air pump device is designed so that, in alternating manner in response to a walking movement of a user, air is sucked in from outside the shoe via the air intake channel when a load is removed (the shoe is lifted off the ground) and air is blown into the shoe interior space through channels when a load is applied (when the shoe comes into contact with the ground and supports the user's weight). A first valve is arranged in the air intake channel and is designed to allow air to pass only in the direction from outside the sole structure into the air pump device. A second valve is arranged in the air supply device, and is designed to allow air to pass only in the direction from the air pump device to the channels. The pump effect may be enhanced further if the outsole has a raised area on the outer tread in the region of the air pump device, which area is pressed towards the upper part of the sole when the load of the user's foot is placed upon it.

One of the suggestions described in EP 2 218 348 A1 is that the intermediate sole be arranged between a hard outsole and an additional sole, wherein the intermediate sole should be manufactured from a material that is more compressible (more elastic/softer) than that of the outsole and that of the additional sole.

In order to achieve good ventilation of the shoe interior space, that is to say effective airflow, it is essential that during each step when the user is walking a sufficiently large quantity of air is sucked into the bellows from the outside and also that it is then blown out of the bellows and into shoe interior space. In order for the greatest possible quantity of air to be blown into the shoe interior space when the load is applied during each step, not only must the volume of the bellows be maximised; it must also be ensured that when the load is applied the bellows is compressed almost completely, or at least mostly, so that the air it contains is forced out. Complete or substantial compression can be ensured by making the sole structure surrounding the cavity very pliable or soft, so that it is completely compressed by the effect of the user's bodyweight. However, the bellows must also expand and fill with air as completely as possible after the load is removed and before it is applied again (in the next step). Such a recovery is achieved with a sole material surrounding the cavity that is as elastically hard as possible. However, this conflicts with the previously stated requirement that the material be as soft as possible.

SUMMARY

In the light of these considerations, it is an object of the invention to create a shoe having a sole structure and an air pump device that enables maximum airflow in each step of a walking or running motion.

According to the invention this object is solved by a shoe having the features of claim 1.

The shoe according to the invention comprises a sole structure with a top side facing towards a shoe interior space, and an air pump device for blowing air into the shoe interior space. The air pump device comprises a bellows formed in a cavity in a heel area of the sole structure, an intake channel coupled to the bellows for transporting air to the bellows from an intake opening, and an air supply device coupled to the bellows for forwarding air from the bellows into the interior space of the shoe. In some variants, the intake channel and/or the air supply device may have several conduits (e.g. tubes, pipes) operating in parallel. Alternatively, in some variants the intake channel and the air supply device may comprise a common duct section which opens into the cavity. Preferably, the intake channel and the air supply device both have valves to ensure that the air is always transported in the desired direction. For the purposes of this specification, the term "bellows" is intended to functionally denote a device that completely encloses a volume of air (except for openings for the intake channel and the air supply device) and which presses air through the openings when the bellows is compressed and sucks air in when the bellows expands. For example, the bellows may be formed solely by the walls of the cavity or by a bladder fitted inside the cavity (made from a soft, elastic plastic, for example), which preferably fills the cavity completely. The sole structure has a multilayer structure at least in the heel area. The multilayer structure comprises at least one cover layer which includes (at least) one layer made from a bending stiff material arranged over the cavity, at least one intermediate layer of a compressible material that contains the cavity, and at least one outsole layer arranged below the cavity. Intermediate layer and outsole layer are preferably made from different materials (each being suitable for its respective function), although in one embodiment they may also be made from the same material and accordingly may even be manufactured as a single part. For example, the cover layer may consist solely of the layer of the bending stiff material; but it may also be of multilayer design, wherein the layer of the bending stiff material may constitute a bottom, a top or a middle layer. In some embodiments the layer of the bending stiff material itself may also be of multilayer design. In further embodiments, the layer of the bending stiff material may for example also form an insole at the same time, which—although this usually forms a part of the upper for purposes of shoemaking—should be considered functionally as part of the sole structure here. In other embodiments, the insole may additionally be arranged over the layer of the bending stiff material. The layer of the bending stiff material forms a stiff plate that overlaps the cavity. For this purposes of this document "overlaps" means that the bending stiff plate extends horizontally as far as the edges of the cavity, and preferably beyond them. The cavity extends horizontally over most of the surface of the heel area, so that a support strip of the compressible material or materials of the at least one intermediate layer remains between the cavity and the outside edges of the sole structure on the sides and at the heel. The bending stiff plate covering the cavity preferably extends horizontally beyond the edge of the cavity and over most of the support strip. The support strip extends vertically over the full height of the cavity, and the average width of the support strip is not more than 20% of the maximum width of the heel area, measured transversely to the walking direction. The cavity has an average height of at least 4 mm, although the cavity in shoes having a length of about 25 cm and more preferably has an average height of at least 6 mm. At least in the area of the support strip, the compressible material has an average hardness between 30 and 55 Shore-A. For example, if the support strip comprises several different materials, "average hardness" refers to a hardness averaged over the entire support strip volume. For example, the support strip might be harder in a region close to the cavity than in a more distant region, or vice versa. In embodiments in which the bellows comprises a bladder of an elastic plastic material inserted in the cavity, in particular filling the cavity, the plastic material of the bladder wall adjacent to the support strip should be taken into consideration for determining the "average hardness" of the support strip. For example, if the bladder wall is made from a material that is stiffer, elastically harder than the other material of the support strip, this results in a higher "average hardness" of the compressible material of the strip.

The desired high airflow (more than 5 ml) for each step of a walking or running motion can be obtained in particular by the combination of a large cavity for the bellows (due to the minimum height and narrow widths of the support strip) with the coverage by a bending stiff plate and selection of the material for the intermediate layer that constitutes the support strips taking into consideration the Shore-A hardness thereof. The coverage of the bellows formed in the cavity by the bending stiff plate ensures that the bellows is compressed over the entire horizontal expanse thereof, i.e. including its edge regions, so that its pump volume is used more efficiently.

In a preferred embodiment of the shoe, the compressible material has a hardness between 45 and 55 Shore-A. This enables optimum compressibility with support strip widths in the range from 10-20% of the maximum width of the heel area measured transversely to the walking direction.

An advantageous further development of the invention is characterised in that the compressible material is a viscoelastic material, particularly a plastic that exhibits a recovery of at least 80%, preferably at least 90% within a period of 0.3 s when the load thereon is abruptly completely removed following compression (in particular as when the shoe is lifted off the ground when walking). This addresses the fact that the usual elastic plastics do not exhibit purely elastic behaviour, but rather viscoelastic behaviour, so that the complete removal of a load from the heel area of the shoe does not result in an immediate (or abrupt) and complete recovery movement, but rather a slower recovery which is still not complete after a certain period. The compressible material is preferably a viscoelastic material that undergoes time-dependent but largely reversible deformation (and thus preferably replicates or approximates the model of a Kelvin body). This ensures a long-lasting pump effect with high flowrate.

A preferred further development of the invention is characterised in that the top side of the support strip comprises a wide support surface for the at least one cover layer, and the support strip width decreases downwardly starting from the wide support surface, wherein the inner surface of the support strip which borders the cavity recedes to the outside. This has two advantages: Firstly, the broad support area enables the cover layer to be attached more effectively and more reliably, wherein the support area serves for example a surface for the application of adhesive; secondly, the recession of the support strip inner wall to the outside ensures maximum cavity volume. A shoe according to this further development is preferably characterised in that the width of the support area is in the range between 9 mm and 18 mm, wherein a smaller value for smaller shoe sizes and a larger value for larger shoe sizes is preferred.

On the basis of this further development, it is preferred that starting from the wide support surface the support strip width initially decreases strongly and then decreases less with increasing distance from the support surface, so that an interior surface is formed that arches outwards. Starting downwards from the wide support surface, the support strip width preferably decreases in an upper subarea and then increases again in a lower subarea, the upper and lower subareas each occupying 20-50% of the cavity height. It has been found that this concave recession of the support strip inner wall forms a predetermined deliberate deformation point under the compressive load of a step, thus enabling selectively adjustable deformation behaviour of the support strips and better (almost complete) compression of the bellows.

In a preferred embodiment of the shoe according to the invention, the bending stiff plate has a bending stiffness with which a force of 1000 N acting on the middle of the bending stiff plate that is supported at its edges (without edge clamping) causes a deflection of not more than 10% of the width of the plate. This limitation of the maximum deflection also serves to ensure the most complete compression possible of the bellows covered by the bending stiff plate and avoids any undesirable loading on the cover layer structure, particularly creasing due to the heel sinking too far under load.

In a preferred embodiment of the shoe according to the invention, the outsole layer arranged below the cavity and, if present, also the parts (e.g. layers) of the intermediate layer arranged between the cavity and the outsole layer protrude downwards, so that the cavity is extended downwards. This bulge is preferably in the order of about 2-4 mm, in shoe sizes longer than 25 cm preferably in the order of about 3-6 mm. In sport shoes, the region may bulge by about 8 mm. This advantageous feature also serves to increase the pump volume.

The shoe according to the invention is preferably characterised in that the intake channel coupled to the bellows for transporting air from an intake opening to the bellows has a minimum cross sectional area of 3 $mm^2$, for shoe sizes longer than about 25 cm a minimum cross sectional area of 4 $mm^2$. This minimum cross section ensures a lower flow resistance when the air is sucked in, and thus contributes to a faster, and accordingly (given the recovery time limited by the time taken for a step) largely complete recovery when the bellows expands after the load is removed from the heel area. In this context, the intake opening is preferably screened with a with a dirt-repellent mesh (e.g., plastic mesh or net) and has a larger minimum area than the minimum cross sectional area of the intake channel to compensate for the greater flow resistance caused by the dirt-repellent mesh.

In one embodiment the cover layer over the layer of bending stiff material comprises a cushion layer made from a softer material and/or a cover sole with a layer that has been adapted on top to the shape of the heel (shape of the footbed). This enhances wearing comfort, because the heel does not bear directly on the bending stiff plate.

In a preferred embodiment, the bellows formed in the cavity of the sole structure comprises a bladder inserted in the cavity, which bladder is made from an elastic plastic material, wherein the intake channel comprises at least a first plastic pipe that opens into the bladder and the air supply device comprises at least a second plastic pipe which is coupled to the bladder. With this configuration, the essential parts of the air pump device can be prefabricated and subsequently introduced into the sole structure. It also simplifies production of the bellows. The selection of the elastic plastic material and the wall thickness of the bladder enable a construction that allows the bellows to expand faster after the load has been removed from the heel area. The bladder, the at least one first plastic pipe and the at least one second plastic pipe are preferably made from the elastic plastic material and inserted in the cavity in the at least one intermediate layer (of the compressible material). This serves to further simplify production of the sole structure.

In a preferred further development of the shoe according to the invention, straight and/or curved bending rods are arranged inside the bladder and are fastened to the wall of the bladder adjacent to the top side of the cavity and to the wall of the bladder adjacent to the bottom side of the cavity in such manner that they are inclined relative to the horizontal, and the bending rods are deformed elastically when the bladder is squeezed. This enables the bellows to expand faster and more completely after the load has been removed from the heel area.

Advantageous and/or preferred further developments of the invention are characterised in the subclaims.

BRIEF DESCRIPTION OF THE DRAWINGS

In the following, the invention will be explained in greater detail with reference to preferred embodiments represented in the drawing. In the drawing.

DETAILED DESCRIPTION OF ILLUSTRATIVE EMBODIMENTS

Figure 1:
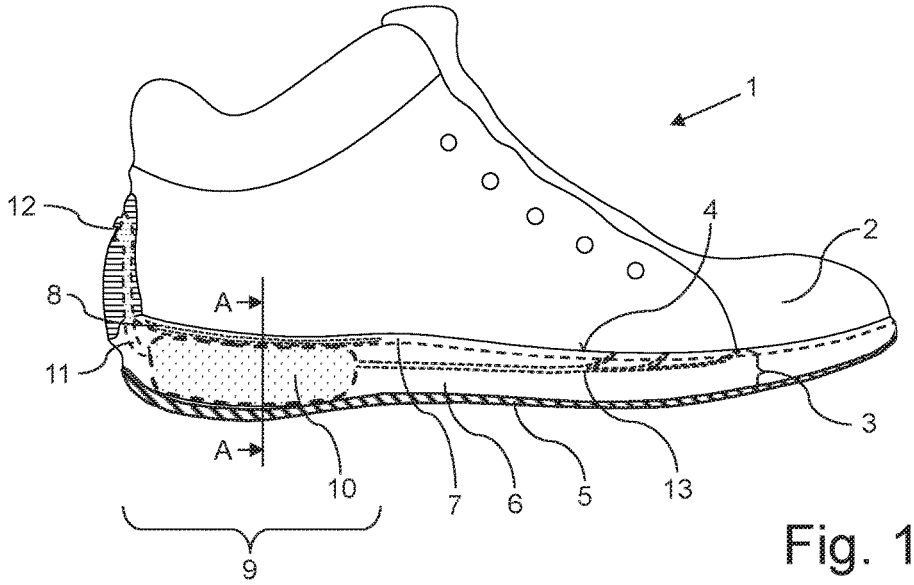
FIG. 1 is a diagrammatic side view of a shoe according to the invention with a sole structure and air pump device.

FIG. 1 is a diagrammatic side view of a shoe 1 according to an embodiment of the invention. Shoe 1 comprises an upper 2 and a sole structure 3, the top side 4 of which faces into the interior space of shoe 1. For the purpose of the description of the present invention, all components of the shoe that are located between the interior space of shoes 1 and the underside of an outsole that comes into contact with the ground are considered to be components of the sole structure. This definition must be stated explicitly here because parts of this sole structure, particularly the insole, can be considered part of the upper for manufacturing purposes. Sole structure 3 is sometimes also called the floor of the shoe. In the shoe 1 according to the invention shown in FIG. 1, sole structure 3 comprises (from bottom to top) an outsole layer 5, an intermediate layer 6 and a cover layer 7. Each of these layers may themselves comprise several components, particularly several layers. In an embodiment not shown in FIG. 1, outsole layer 5 and intermediate layer 6 may be designed from the same material and even produced as a single part. Preferably, however, outsole layer 5 and intermediate layer 6 comprises different materials, wherein the material is chosen with a view to the function of the respective layers.

The shoe according to the invention is equipped with an air pump device for blowing air into the interior space of the shoe. The air that is blown into the interior space of the shoe is preferably sucked in through an opening in the outside of the shoe, so that fresh air can be supplied to the interior space of the shoe. In a less preferred alternative embodiment, the air that is blown into the interior space of the shoe can also be sucked in at a site in the interior space of the shoe which is closer to the foot opening (that is to say, the upper opening into the interior space of the shoe) than the openings through which the air is blown into the interior space. The air pump device has a bellows formed in cavity in a heel area of the sole structure, an intake channel coupled to the bellows for transporting air from the intake opening into the bellows, and an air supply device coupled to the bellows for forwarding air from the bellows to the interior space of the shoe.

In the embodiment shown in FIG. 1, the intake channel 11 comprises a tubular line that opens into cavity 10 and is routed upwards from intermediate layer 6 in the heel area along upper 2 in such manner that intake opening 12 is positioned above sole structure 3. The higher intake opening 12 is positioned, the less risk there is that dust and moisture stirred up from the ground will be sucked in with the air by the air pump device. In the preferred embodiment represented schematically in FIG. 1, intake channel 11 is mostly accommodated in a plastic component that is coupled to sole structure 3, which component is fastened to the back of upper 2. In alternative embodiments, the plastic component may also be routed inside upper 2, between an outer upper element and an inner upper element (lining). In the latter case, intake opening 12 may also be located on the top border of the upper, that is to say on the foot opening. In other embodiments, intake channel 11 may also be formed in an air supply device on the side of the shoe, as is described in EP 2 772 151 A1 for example. Intake channel 11 may also comprise multiple tubes or pipes that transport the air from intake openings to cavity 10, which may be conformed at various positions on the shoe. Air supply device 13 may also include one or more channels or conduits that open into cavity 10. The channels of air supply device 13 that lead away from cavity 10 may open into openings on top side 4 of sole structure 3. In one embodiment, the air leaving from cavity 10 is first forced into a channel of air supply device 13. The channel then branches into a plurality of smaller channels, which in turn then end at openings on the top side of intermediate sole 6. A cover layer placed over intermediate sole 6 consists for example of an insole which also has passthrough openings at the locations where the channels on the top side of the intermediate layer end, which then open into the interior space of the shoe. If cover layer 7 comprises multiple layers arranged one on top of the other, including the insole, each of these layers has openings that correspond with each other, and which serve to connect air supply device 13 with the interior space of the shoe. Embodiments are also conceivable in which intake channel 11 and air supply device 13 are not coupled to separate openings in the cavity but are each coupled to a collector line, which opens into cavity 10 at one opening. A valve is located at the point where the collector line branches into the intake channel and the air supply device, and said valve may either provide the connection between the collector line and the intake channel or between the collector line and the air supply device depending on the pressure conditions (compression or expansion) prevailing in the cavity and the collector line. In addition, further embodiments are conceivable in which the air supply device comprises a line that connects cavity 10 in heel area 9 with a manifold cavity located under the ball or toe area in intermediate layer 6 and/or cover layer 7, wherein this manifold cavity is filled for example with an open-pored material or an air-permeable, wide-meshed but mechanically stable tissue or fleece, so that the air supplied via the line from cavity 10 is able to spread through the ball area inside the manifold cavity. The layers arranged over this manifold cavity then include passthrough holes, from which the air that is distributed in the manifold cavity exits into the interior space of the shoe. Such an arrangement is known from EP 2 218 348 A1 for example.

In the shoe according to the invention, of which a preferred embodiment is represented schematically in FIG. 1, at least in heel area 9 sole structure 3 has a multilayer structure comprising at least outsole layer 5, intermediate layer 6 made from a compressible material, and a cover layer that comprises a layer of bending stiff material arranged over cavity 10. The layer of bending stiff material forms a bending stiff plate 8 that covers cavity 10. Stiff plate 8 in the embodiment according to FIG. 1 overlaps cavity 10 and is formed only in heel area 9. In alternative embodiments the stiff plate may also extend beyond heel area 9. Cover layer 7 may comprise multiple layers, of which one is the layer of bending stiff material. In other embodiments, cover layer 7 may also consist entirely of bending stiff material. In preferred embodiments, cover layer 7 comprises the insole. In other embodiments, the insole may be arranged over a separate layer of bending stiff material, which constitutes the bending stiff plate.

Figure 2:
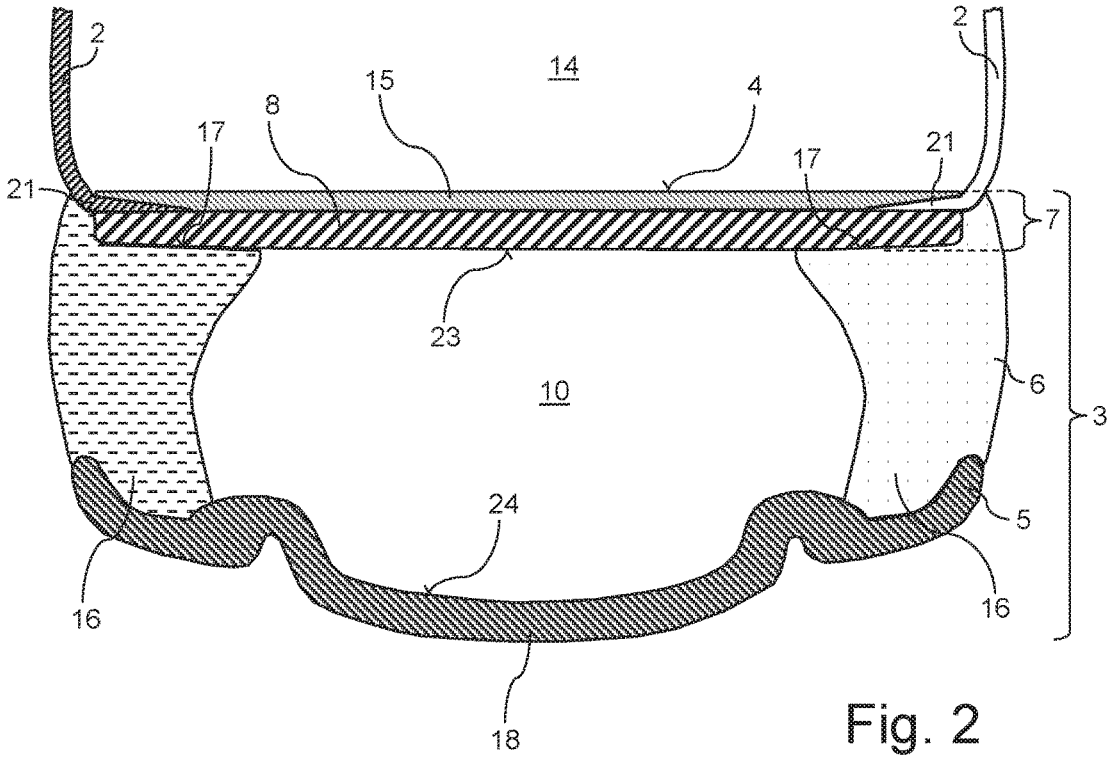
FIG. 2 is a diagrammatic cross section through the heel area of the shoe along plane A-A of FIG. 1.

FIG. 2 shows a diagrammatic cross section through the sole structure along plane A-A according to FIG. 1. In this embodiment, sole structure 3 comprises an outsole layer 5, which includes a bulge 18 below cavity 10 of such kind that the outsole layer protrudes downwards and cavity 10 is enlarged. Sole structure 3 further comprises an intermediate layer 6 made from a compressible material. Cavity 10 extends horizontally over most of the surface of heel area 9, with the result that a support strip 16 of the compressible material of the intermediate layer (or also the compressible material of multiple intermediate layers arranged one on top of the other—not shown in FIG. 2) remains between cavity 10 and the outside edges on the side and heel areas of sole structure 3. FIG. 2 shows a cross section through the side sections of support strip 16. Strip 16 extends vertically over the full height of cavity 10. The average width of support strip 16 is not more than 20% of the maximum width of heel area 9, measured transversely to the walking direction. In a preferred embodiment, the average strip width is equal to about 14-17% of the maximum width of the heel area transversely to the walking direction. In the embodiment shown in FIG. 2, top side 23 of cavity 10 is formed by the underside of cover layer 7, and bottom side 24 of cavity 10 is formed by the top side of outsole layer 5.

The compressible material of intermediate layer 6 (or—in other embodiments—the compressible materials of the intermediate layers) has an average hardness between 30 and 55 Shore-A at least in the region of support strip 16. Preferably, it has an average hardness between 45 and 55 Shore-A. In preferred embodiments, the compressible material is a viscoelastic plastic material which in the event of a complete removal of load abruptly following a compression (sudden raising of the foot off the ground) exhibits a recovery of at least 80%, preferably at least 90% within a period of 0.3 s. A period of 0.3 s was chosen as a reference time for recovery because this time approximately corresponds to the time that is for expansion in a fast step frequency. The compressible material for the intermediate layer is preferably chosen from polyurethane foam, ethylvinyl acetate (EVA) or—preferably—expanded thermoplastic polyurethane (eTPU) with closed-cell foam. In one embodiment, the intermediate layer comprises a polyurethane foam having a density between 0.45 and 0.5 g/cm$^3$. A plastic of which the deformation remains practically entirely reversible even after a large number of loading and unloading cycles is preferred. An expanded thermoplastic polyurethane (eTPU) with high recovery capability, and which has high rebound elasticity with a rebound height greater than 45% (measured in a ball rebound test according to DIN EN ISO 8307) is particularly preferred.

In the embodiment shown in FIG. 2, cover layer 7 comprises a bending stiff plate 8 consisting of a bending stiff material which is positioned over a support surface 17 of support strip 16 of intermediate layer 6, and an insole 15 arranged over this, which insole is coupled to the material of upper 2 (at a lasting margin 21, for example). The layer of rigid material that forms bending stiff plate 8 is preferably bonded to contact area 17 of support strip 16 with adhesive. Insole 15 is bonded adhesively to stiff plate 8. Various embodiments for joining insole 15 to upper 2 are possible, but these are not so important in the context of the present invention. For example, insole 15 may be bonded to the material of upper 2 in a region where the materials lie flat against one another (lasting margin 21). The material of the upper is stitched to the material of the insole by a special method known as the "Strobel" method, which is not shown. A cover sole (not shown in FIG. 2) may be arranged over insole 15 as a further component of cover layer 7. Cover sole may comprise a cushion layer made from a soft material and/or a layer whose top side is conformed to the shape of the heel.

Figure 3:
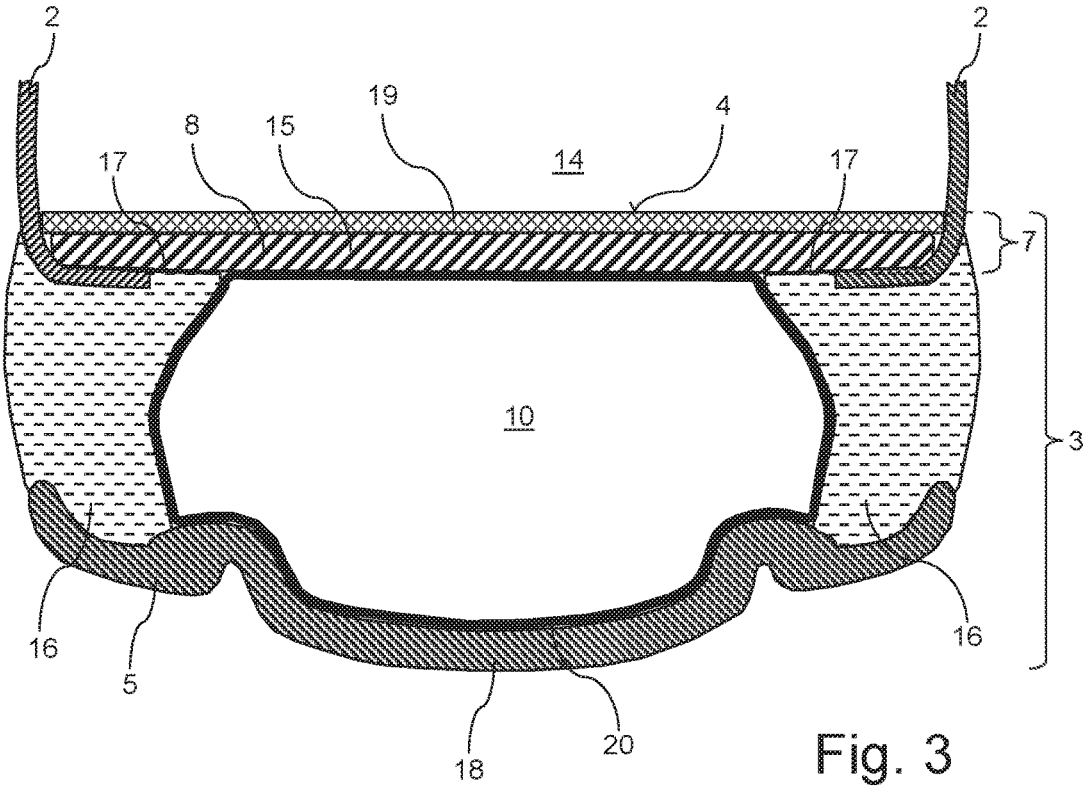
FIG. 3 is a diagrammatic cross section through the heel area of an alternative embodiment.

FIG. 3 is a diagrammatic representation of an alternative embodiment of sole structure 3. Outsole layer 5 including bulge 18 and support strips 16 of intermediate layer 6 are constructed as in the embodiment of FIG. 2. In the embodiment shown in FIG. 3, the air pump device comprises a bladder 20 made from an elastic plastic material, which substantially fills cavity 10. In this embodiment, bladder 20 lies on the top side of outsole layer 5, on the inner walls of support strips 16 and the underside of cover layer 7. Bending stiff plate 8 of cover layer 7 is formed by insole 15 itself. The material of upper 2 is for example bonded adhesively to the underside of insole 15, wherein the composite structure of upper 2 and insole 15 is bonded adhesively to intermediate layer 6, that is to say to the support areas 17 of strip 16 of intermediate layer 6 in heel area 9. A cover sole 19 made from a soft material is arranged over insole 15. FIG. 3 is merely a diagrammatic representation which provides a simplified illustration of the bond between upper 2 and insole 15. In fact, insole 15 and the material of upper 2 are usually bonded to each other adhesively with the aid of a device called a lasting margin, as is represented in FIG. 2.

In the embodiments shown in FIGS. 2 and 3, cavity 10 extends over the entire height of intermediate layer 6 in heel area 9. But other embodiments are also imaginable in which the material of intermediate layer 6 (or of one of several intermediate layers) may also be arranged above cavity 10 and below cover layer 7 and/or below cavity 10 and above outsole layer 5. This may be the case particularly when multiple intermediate layers are provided.

In a preferred embodiment, particularly an embodiment that uses the bladder 20 shown in FIG. 3, straight and/or curved bending rods may be arranged in cavity 10 between top side 23 and bottom side 24 of cavity 10, which rods are coupled to the material adjacent to top side 23 and bottom side 24 in such a way that they are inclined with respect to the horizontal, wherein the bending rods are deformed elastically when cavity 10 is compressed.

Figure 4:
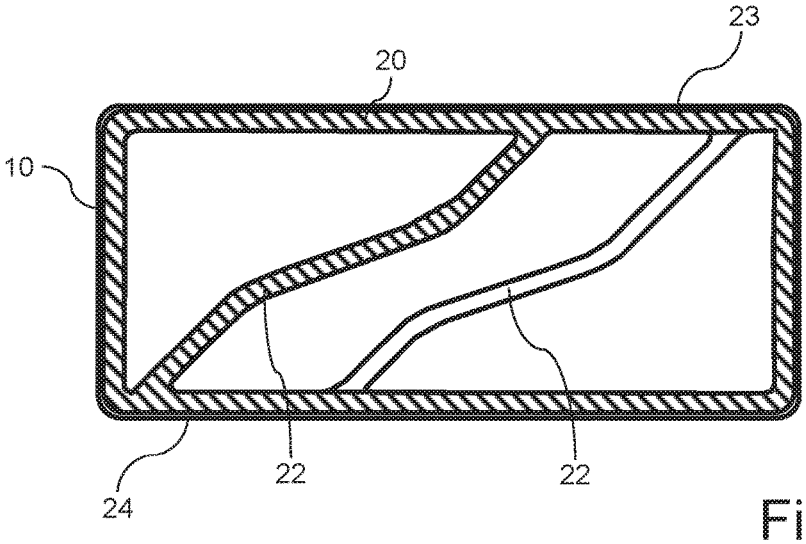
FIG. 4 is a diagrammatic cross section in the longitudinal direction of the shoe through a bladder in an embodiment that includes bending rods inside the bladder.

FIG. 4 illustrates an embodiment in which bending rods 22 are arranged inside a bladder 20 that fills a cavity 10. In this diagrammatic cross sectional representation, for the sake of simplicity only two bending rods 22 are shown, of which one (cross-hatched) bending rod 22 is positioned in the section plane and the other is behind the section plane. Bending rods 22 preferably comprise the material of the bladder, that is to say an elastic plastic. They are coupled to the wall of bladder 20 in such manner that they are aligned at an angle to the horizontal. In the diagrammatically represented embodiment, bending rods 22 are not straight but curved, so that they are deformed in a certain, predetermined way when cavity 10 and therewith bladder 20 is compressed.

Many alternative embodiments are conceivable within the scope of the inventive thought. For example, two or more bladders, each with associated suction channels and air supply devices may be provided in cavity 10, or cavity 10 may be divided by partitions into two of more sub-cavities, each with associated suction channels and air supply devices.

The invention claimed is:

1. A shoe comprising a sole structure having a top side facing a shoe interior space, and an air pump device for blowing air into the shoe interior space, wherein the air pump device comprises:

a bellows formed in a cavity in a heel area of the sole structure;

an intake channel coupled to the bellows for transporting air to the bellows from an intake opening; and an air supply device coupled to the bellows for forwarding air from the bellows into the shoe interior space;

wherein the sole structure has, at least in the heel area, a multilayer structure comprising:

at least one cover layer comprising a layer of a bending stiff material arranged over the cavity;

at least one intermediate layer of a compressible material, the intermediate layer containing the cavity; and at least one outsole layer arranged below the cavity;

wherein the layer of the bending stiff material forms a bending stiff plate that overlaps the cavity;

wherein the cavity extends horizontally over most of the surface of the heel area so that a support strip of the compressible material of the at one intermediate layer remains between the cavity and the outside edges of the sole structure on the sides and at the heel;

wherein the support strip extends vertically over the full height of the cavity and the average width of the support strip is not more than 20% of the maximum width of the heel area measured transversely to the walking direction;

wherein the cavity has an average height of at least 4 mm; and wherein the compressible material has an average hardness between 30 and 55 Shore-A at least in the area of the support strip.

2. The shoe according to claim 1, wherein the compressible material has an average hardness between 45 and 55 Shore-A.

3. The shoe according to claim 2, wherein the compressible material is a viscoelastic material which exhibits a recovery of at least 80% within a period of 0.3 s when a load thereon is abruptly removed entirely following a compression.

4. The shoe according to claim 3, wherein the bellows formed in the cavity of the sole structure comprises a bladder made from an elastic plastic material which is inserted in the cavity, wherein the intake channel comprises at least one first plastic pipe which opens into the bladder, and the air supply device comprises at least one second plastic pipe which is coupled to the bladder.

5. The shoe according to claim 3, wherein the compressible material exhibits a recovery of at least 90% within a period of 0.3 s when a load thereon is abruptly removed entirely following a compression.

6. The shoe according to claim 2, wherein a top side of the support strip comprises a wide support surface for the at least one cover layer, and a width of the support strip decreases downwardly starting from the wide support surface, wherein the inner surface of the support strip which borders the cavity recedes to the outside.

7. The shoe according to claim 6, wherein starting from the wide support surface the width of the support strip initially decreases strongly and then decreases less with increasing distance from the wide support surface, so that an interior surface is formed that arches outwards.

8. The shoe according to claim 2, wherein the bending stiff plate has a bending stiffness with which a force of 1000 N acting on a middle of the bending stiff plate that is supported at its edges causes a deflection of not more than 10% of the width of the plate.

9. The shoe according to claim 1, wherein the cavity has an average height of at least 6 mm.

10. The shoe according to claim 1, wherein the compressible material is a viscoelastic material which exhibits a recovery of at least 80% within a period of 0.3 s when a load thereon is abruptly removed entirely following a compression.

11. The shoe according to claim 10, wherein the compressible material exhibits a recovery of at least 90% within a period of 0.3 s when a load thereon is abruptly removed entirely following a compression.

12. The shoe according to claim 10, wherein a top side of the support strip comprises a wide support surface for the at least one cover layer, and a width of the support strip decreases downwardly starting from the wide support surface, wherein the inner surface of the support strip which borders the cavity recedes to the outside.

13. The shoe according to claim 12, wherein starting from the wide support surface the width of the support strip initially decreases strongly and then decreases less with increasing distance from the support surface, so that an interior surface is formed that arches outwards.

14. The shoe according to claim 12, wherein the bending stiff plate has a bending stiffness with which a force of 1000 N acting on a middle of the bending stiff plate that is supported at its edges causes a deflection of not more than 10% of the width of the plate.

15. The shoe according to claim 10, wherein the bending stiff plate has a bending stiffness with which a force of 1000 N acting on a middle of the bending stiff plate that is supported at its edges causes a deflection of not more than 10% of the width of the plate.

16. The shoe according to claim 1, wherein a top side of the support strip comprises a wide support surface for the at least one cover layer, and a width of the support strip decreases downwardly starting from the wide support surface, wherein the inner surface of the support strip which borders the cavity recedes to the outside.

17. The shoe according to claim 16, wherein the width of the wide support surface is in the range between 9 mm and 18 mm, wherein a smaller value for the width of the wide support surface for smaller shoe sizes and a larger value for the width of the wide support surface for larger shoe sizes is preferred.

18. The shoe according to claim 17, wherein the bellows formed in the cavity of the sole structure comprises a bladder made from an elastic plastic material which is inserted in the cavity, wherein the intake channel comprises at least one first plastic pipe which opens into the bladder, and the air supply device comprises at least one second plastic pipe which is coupled to the bladder.

19. The shoe according to claim 16, wherein the bending stiff plate has a bending stiffness with which a force of 1000 N acting on a middle of the bending stiff plate that is supported at its edges causes a deflection of not more than 10% of the width of the plate.

20. The shoe according to claim 19, wherein the outsole layer arranged below the cavity and parts of the intermediate layer arranged between the cavity and the outsole layer protrude downwards, so that the cavity is extended downwards.

21. The shoe according to claim 16, wherein starting from the wide support surface a width of the support strip initially decreases strongly and then decreases less with increasing distance from the support surface, so that an interior surface is formed that arches outwards.

22. The shoe according to claim 16, wherein the bending stiff plate has a bending stiffness with which a force of 1000 N acting on a middle of the bending stiff plate that is supported at its edges causes a deflection of not more than 10% of the width of the plate.

23. The shoe according to claim 1, wherein the bending stiff plate has a bending stiffness with which a force of 1000 N acting on a middle of the bending stiff plate that is supported at its edges causes a deflection of not more than 10% of the width of the plate.

24. The shoe according to claim 23, wherein the outsole layer arranged below the cavity and, if present, the parts of the intermediate layer arranged between the cavity and the outsole layer protrude downwards, so that the cavity is extended downwards.

25. The shoe according to claim 1, wherein the bellows formed in the cavity of the sole structure comprises a bladder made from an elastic plastic material which is inserted in the cavity, wherein the intake channel comprises at least one first plastic pipe which opens into the bladder, and the air supply device comprises at least one second plastic pipe which is coupled to the bladder.

26. The shoe according to claim 1, wherein the outsole layer arranged below the cavity and parts of the intermediate layer arranged between the cavity and the outsole layer protrude downwards, so that the cavity is extended downwards.

27. The shoe according to claim 1, wherein the intake channel coupled to the bellows for transporting air from an intake opening to the bellows has a minimum cross sectional area of 3 $mm^2$, for shoe sizes longer than about 25 cm a minimum cross sectional area of 4 $mm^2$.

28. The shoe according to claim 1, wherein the cover layer over the layer of bending stiff material comprises a cushion layer made from a softer material and/or a cover sole with a layer that has been adapted on top to the shape of the heel.

29. The shoe according to claim 1, wherein the bellows formed in the cavity of the sole structure comprises a bladder made from an elastic plastic material which is inserted in the cavity, wherein the intake channel comprises at least one first plastic pipe which opens into the bladder, and the air supply device comprises at least one second plastic pipe which is coupled to the bladder.

30. The shoe according to claim 29, wherein the bladder, the at least one first plastic pipe and the at least one second plastic pipe are manufactured as a single part from the elastic plastic material and inserted in the cavity in the at least one intermediate layer of the compressible material.

31. The shoe according to claim 29, wherein straight and/or curved bending rods are arranged inside the bladder and are fastened to the wall of the bladder adjacent to the top side of the cavity and to the wall of the bladder adjacent to the bottom side of the cavity in such manner that they are inclined relative to the horizontal, and the bending rods are deformed elastically when the bladder is squeezed.

* * * * *